US005356155A

United States Patent [19]

Gross

[11] Patent Number: 5,356,155

[45] Date of Patent: Oct. 18, 1994

[54] LOOSE LEAF BOUND BOARD GAMES

[76] Inventor: David L. Gross, 141-39 71st Ave., Flushing, N.Y. 11367

[21] Appl. No.: 174,988

[22] Filed: Dec. 29, 1993

[51] Int. Cl.[5] ..... A63F 3/00

[52] U.S. Cl. ..... 273/284

[58] Field of Search ..... 273/236, 242, 243, 248, 273/249, 268, 269, 275, 283, 284, 287

[56] References Cited

U.S. PATENT DOCUMENTS

| | | | |
|---|---|---|---|
| 2,055,159 | 9/1936 | Scofield | 273/284 X |
| 2,379,465 | 7/1945 | Vollmer | 273/287 X |
| 3,051,489 | 8/1962 | Goldschmidt | 273/284 |
| 3,844,563 | 10/1974 | Isaac | 273/284 X |
| 4,043,559 | 8/1977 | Eigen et al. | 273/284 X |
| 4,556,213 | 12/1985 | Sharma | 273/284 X |
| 4,606,554 | 8/1986 | Lederman | 273/284 X |
| 5,213,326 | 5/1993 | Randell et al. | 273/269 X |
| 5,286,025 | 2/1994 | Malyca et al. | 273/269 X |

FOREIGN PATENT DOCUMENTS

| | | | |
|---|---|---|---|
| 474929 | 11/1937 | United Kingdom | 273/284 |

*Primary Examiner*—William E. Stoll

*Attorney, Agent, or Firm*—Ostrolenk, Faber, Gerb & Soffen

[57] ABSTRACT

A board game kit includes a loose leaf binder including a bottom panel, a front cover panel, a connecting rib and several binders. A plurality of board games are removably held by the binders. Each of the board games includes an appendage with a series of binder holes, the boards being installed in the binder and secured at their appendages.

13 Claims, 1 Drawing Sheet

FIG. 1
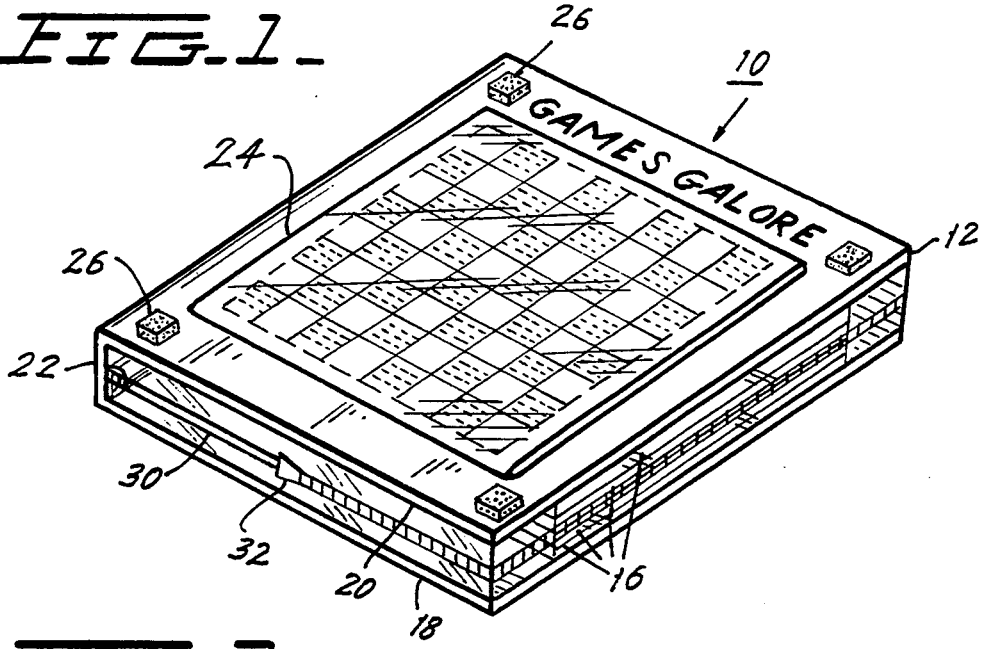
FIG. 2
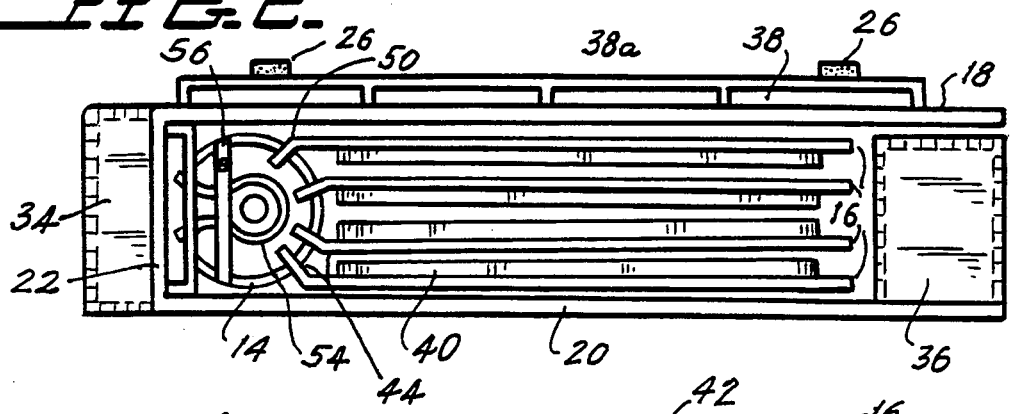
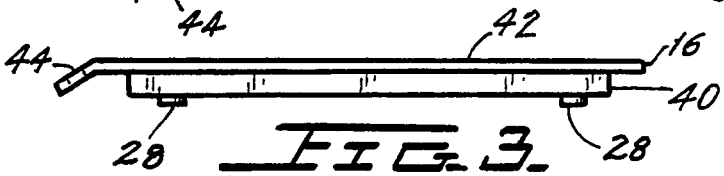
FIG. 3
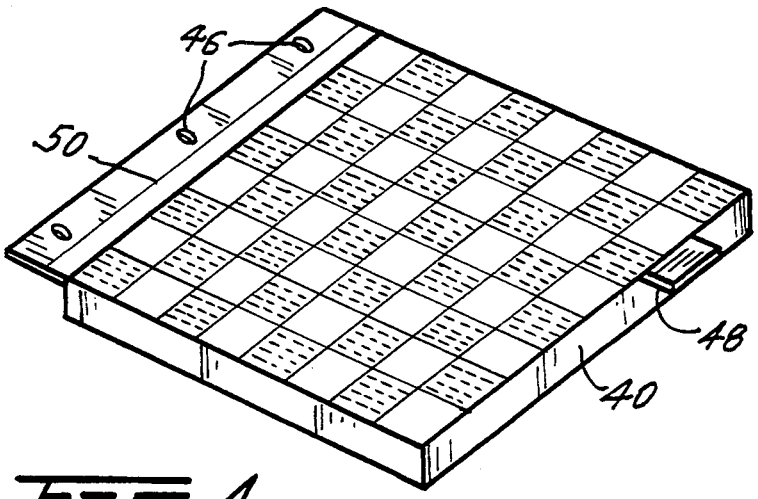
FIG. 4
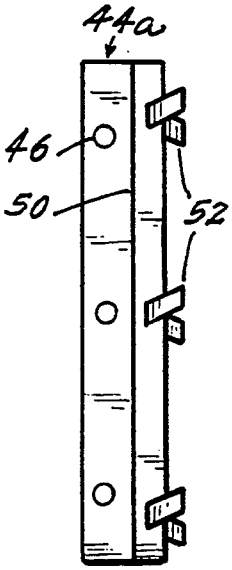
FIG. 5

LOOSE LEAF BOUND BOARD GAMES

BACKGROUND OF THE INVENTION

The present invention generally relates to board games and, in particular, to a kit in the form of a loose leaf binder which provides a menu of several board games to choose from.

Board games such as chess, checkers, backgammon, Chinese checkers, tic-tac-toe, Monopoly®, Scrabble®, Clue®, etc. which both children and adults enjoy typically come packaged in individual boxes. Each box holds the playing board and the playing pieces for the particular game. In the typical family setting that owns many different board games, it is not unusual for the playing pieces and boards to get lost or misplaced or scattered throughout the house. That is because the cardboard boxes of these games tear and are, in any case, not optimal storage boxes.

Often, families on extended trips prefer to pack several board games along with other necessities. However, the board games take up precious suitcase space. Further, they are not designed to prevent the playing pieces from being lost or misplaced or to provide a single package or kit which includes several, different board games. In short, board games are not designed for the utmost convenience in use in homes and particularly for trips away from home.

The prior art is exemplified by several patents including U.S. Pat. No. 4,832,605 which discloses a music teaching and demonstration system which employs a loose leaf notebook with a plastic pocket attached to the outside of its front cover. A metallic sheet is inserted into the pocket and a non-metallic sheet is inserted between the metallic sheet and the inside surface of the pocket. With the use of magnetic pieces, teaching of music is claimed to be facilitated. The system is also described for teaching reading or spelling. However, this reference does not teach the use of a loose leaf bound kit holding a plurality of board games and a collection of playing pieces for the various games in the manner of the present invention to be described.

U.S. Pat. No. 4,513,974 discloses a uniquely shaped chess box that has been adopted to also hold a number of various board games and their playing pieces inside the box, which box is simply sufficiently large to hold several board games and their playing pieces. However, the playing pieces are susceptible to being scattered and the board games removed or misplaced.

Another type of game storage box is disclosed in U.S. Pat. No. 4,781,384.

U.S. Pat. No. 4,043,559 discloses an educational game which does not include a loose leaf for holding a plurality of games.

A game table designed for use in playing a large number of board games which can be brought into playing position on the table by turning a crank handle is disclosed in U.S. Pat. No. 3,926,439.

A game board in the form of a bound book is disclosed in U.S. Pat. No. 343,496.

SUMMARY OF THE INVENTION

A primary objective of the present invention is to provide a kit in the form of a loose leaf binder which holds a plurality of board games and their playing pieces, so as to provide considerably improved versatility, ease of use, storage and portability for board games.

It is a further object of the present invention to provide a kit of loose leaf bound board games in which the board games can be of standard or reduced size, e.g., half size, and which include magnetic pieces or pieces which can be otherwise secured to the board game, e.g. by Velcro or other means.

It is a further object of the present invention to provide a kit of loose leaf bound board games which includes various compartments for separately holding the playing pieces associated with the various board games.

It is yet another object of the invention to provide a kit of loose leaf bound board games which can be inexpensively fabricated and which is more practical to use and store in a typical home with children.

The foregoing and other objects of the invention are realized in accordance with the present invention by a board game kit which is comprised of a loose leaf binder including a bottom panel, a front panel, a connecting rib and several binders. A plurality of board games, for example chess, checkers, Monopoly®, Scrabble®, etc., are held in the loose leaf binder, each by a respective appendage provided with a series of binder holes. The appendage could be formed as an integral portion of the board game or it can be separately provided and include holding means such as hand-operable clips by which to hold the board games.

In accordance with various enhancements of the basic board game kit, the kit may be provided with one or more compartments for playing pieces. It can also include a plastic, transparent pocket secured to the top of the loose leaf binder in which a board game retrieved from inside the binder may be placed for the playing therewith. Each of the board games can have a magnetized surface or a plurality of individual VELCRO (hook or loop fasteners) dots so that metallic playing pieces or playing pieces with corresponding Velcro dots may be securely placed on the board games, without risk that they may be detached therefrom, for example as when a family is traveling in a car, plane, etc.

Further, the board game kit can be configured to either lock the games inside the binder or to make the games retrievable so that several people may use the kit simultaneously playing different games. The kit or the individual games can be finished in plain plastic or paper, or even leather or other expensive materials to provide deluxe editions of the kit and individual games.

Other features and advantages of the present invention will become apparent from the following description of the invention which refers to the accompanying drawings.

BRIEF DESCRIPTION OF THE DRAWINGS

FIG. 1 is a perspective of the kit of loose leaf bound board games in accordance with the present invention.

FIG. 2 provides a side view of the kit of loose leaf bound board games of FIG. 1.

FIG. 3 is a perspective of one of the board games inserts into the loose leaf binder in accordance with one embodiment thereof.

FIG. 4 is a side view of one of the board games of FIG. 2.

FIG. 5 depicts a board game attachment by which a game board can be secured in the loose leaf binder in accordance with one embodiment of the present invention.

DETAILED DESCRIPTION OF THE DRAWINGS

Referring now to the drawings, FIG. 1 illustrates a game kit 10 of the present invention which includes a conventional loose leaf binder 12 having two or more binders 14 (FIG. 2) for receiving and securing a number of board games 16, preferably more than two but less than ten board games. The loose leaf 12 comprises a bottom panel 18, a front cover panel 20 and a connecting rib 22. A clear plastic pocket 24 attached to the outside of the cover panel 20 provides a pocket for holding a game board which has been withdrawn from the loose leaf binder 12 for current playing.

As an alternative to the plastic pocket 24, the front panel 20 can include several Velcro dots 26 and each of the board games 16 be provided with corresponding, mating Velcro dots 28 (FIG. 3) so that the board games 16 may be placed and secured to the front panel 20 to permit playing with board games 16 in a car, plane, etc.

The board games 16 include a selection of familiar games such as chess, checkers, Chinese checkers, backgammon, tic-tac-toe, Monopoly®, Scrabble®, Clue®, etc., indeed any known or future board games. The board games 16 may be of any size, e.g., half size, and preferably are of the type in which a magnetized strip is buried underneath the playing surface and the playing pieces have metallic inserts in their bases so that once placed on any position on the board game they remain in place. Alternatively, instead of using magnetism to hold the playing pieces, the top surfaces of the game boards may be provided with Velcro patches and the playing pieces may be constructed so as to enable them to become attached and secured to the board games.

If desired, a portion (not shown) of the clear plastic pocket 24 may be adapted for the storage therein of various board game accessories such as pens, pencils, erasers, etc. which players might deem useful or necessary for the full enjoyment of the games.

The loose leaf binder panels 18 and 20 and/or the games 16 may be constructed of plastic, fabric, leather, etc., in order to provide the kit in various configurations, including standard or deluxe models.

A band 30 preferably of plastic with a zipper 32 may extend between the bottom and front panels 18 and 20 to provide a fully enclosed space inside the loose leaf binder 12, as shown in FIG. 1.

Referring to FIG. 2, the loose leaf binder 12 may be provided with one or more compartments for playing pieces. For example, a first such compartment 34 is provided at and supported by the connecting rib 22. This compartment may be subdivided into several subcompartments by dividing walls (not shown) so that playing pieces of different games can be segregated from one another. In accordance with another embodiment, a playing piece compartment 36 is provided on the inside surface of the bottom panel 18. In accordance with still another embodiment of the present invention, a further playing piece compartment 38 is provided on the outside of the front cover panel 20, the compartment 38 including several dividing walls 38*a* as shown. The pocket 24 (FIG. 1) may be provided atop the compartment 38. All of the compartments 34, 36 and 38 are of course constructed to be openable to retrieve or store the playing pieces therein.

In accordance with a still further construction of the present invention, the board games 16 may include their own respective playing piece compartments 40, each with an openable panel (fastened by Velcro or the like) through which the playing pieces could be slid into and out of the compartment 40. The playing surface 42 (FIG. 4) constitutes the top of the playing piece compartment 40.

Each board game has an appendage 44 with several punched binder holes 46 through which the binders 14 can pass. Each board game is optionally supplied with a tab 48 indicating the name of the game and also including a numeral indicating the position of the board game in the kit. Thus, each game could be located in an instant and, moreover, a parent or a counselor can determine at a glance whether any of the games is missing from the kit.

Since the arcuately shaped binders 44 may damage or bend the games 16, the appendage 44 is constructed with a pivot 50 as shown. The appendage 44 need not be integral with the board game 16 as shown in FIG. 4. Rather, as shown in FIG. 5, a separately provided appendage 44A includes the punched holes 46, pivot line 50 and, in addition, several clips 52 by which the board games 16 can be secured to the appendage 44A, and thus securely held in the binder 10 for the purposes indicated previously.

It is intended that the board games 16 will be easily placeable in or retrieveable from the binder 12 simply by operating the handle 54 (FIG. 2) of the loose leaf binder 12, to remove or install games as desired. However, for parents, teachers or camp counselors who may wish to ensure that the games 16 are not removed from the kit 10, the invention may be provided with a lock 56 by which accessibility to the binders 14 is prevented, ensuring that games will not be removed by young children or careless adults.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A board game kit, comprising:

a loose leaf binder including a bottom panel, a front cover panel, a connecting rib and several binders; and a plurality of board games, each of the game boards including an appendage with a series of binder holes, said game boards being pivotally installed in said loose leaf binder and being secured therein at said appendages.

2. The board game kit of claim 1, including at least one compartment for playing pieces.

3. The board game kit of claim 2, wherein said at least one compartment includes a compartment located adjacent the connecting rib.

4. The board game kit of claim 2, wherein said at least one compartment includes a compartment which is located inside the loose leaf binder and affixed to the bottom panel thereof.

5. The board game kit of claim 2, further comprising a plurality of hook or loop fasteners in the form of dots affixed to one of the panels of the loose leaf binder and wherein each of said board games comprises counterpart hook or loop fasteners in the form of dots by which each may be secured to the hook or loop fasteners in the form of dots of the loose leaf binder.

6. The board game kit of claim 1, wherein each of the board games comprises an integrally connected playing piece compartment.

7. The board game kit of claim 1, wherein the board games have playing surfaces which are adapted to secure playing pieces to the playing surfaces.

8. The board game kit of claim 1, further comprising a lock to prevent opening of the binder.

9. The board game kit of claim 1, wherein each of the games includes a respective tab identifying the game.

10. The board game kit of claim 1, further comprising a plastic, transparent pocket affixed to the front cover panel and sized to enable the placement therein of any one of said board games.

11. The board game kit of claim 1, wherein the loose leaf binder comprises a plurality of appendages, each of the appendages having means for removably holding a respective game board.

12. The board game kit of claim 11, wherein the means for securing the board game comprises hand-operable clips.

13. The board game kit of claim 1, wherein the board games include at least games of chess, checkers and backgammon.

* * * * *